US005907735A

United States Patent [19]

Ogiwara

[11] Patent Number: 5,907,735

[45] Date of Patent: May 25, 1999

[54] PHOTOSENSITIVE MATERIAL PROCESSING APPARATUS

[75] Inventor: Nagao Ogiwara, Ashigarakami-gun, Japan

[73] Assignee: Fuji Photo Film Co., Ltd., Kanagawa, Japan

[21] Appl. No.: 08/856,009

[22] Filed: May 14, 1997

[30] Foreign Application Priority Data

May 15, 1996 [JP] Japan ..... 8-120619

[51] Int. Cl.[6] ..... G03D 13/00; G03G 5/16

[52] U.S. Cl. ..... 396/575; 396/612; 250/317.1; 250/319

[58] Field of Search ..... 396/575, 612; 355/27–29, 105, 110, 117; 430/30, 203; 250/316.1–319

[56] References Cited

U.S. PATENT DOCUMENTS 5,122,433 6/1992 Kawaguchi ..... 396/575

FOREIGN PATENT DOCUMENTS 0 762 201 A1 12/1997 European Pat. Off. ..... G03C 7/30

07015593 1/1995 Japan ..... H04N 1/17

*Primary Examiner*—D. Rutledge

*Attorney, Agent, or Firm*—Sughrue, Mion, Zinn Macpeak & Seas, PLLC

[57] ABSTRACT

A photosensitive material processing apparatus includes a heating drum, against which a processing sheet is pressed. A film is sandwiched between the processing sheet and the heating drum and is transported thereby while being heated, so that the film undergoes heat development. Accordingly, through a simple development process, images can be formed on the film. In addition, the maintainability of the photosensitive material processing apparatus can be improved.

16 Claims, 5 Drawing Sheets

PHOTOSENSITIVE MATERIAL PROCESSING APPARATUS

BACKGROUND OF THE INVENTION

1. Field of the Invention

The present invention relates to a photosensitive material processing apparatus for forming images on a heat-development-type photosensitive material which is developed by application of heat, and particularly to a photosensitive material processing apparatus in which a processing member is superimposed on the heat-development-type photosensitive material to thereby form images on the heat-development-type photosensitive material through application of heat.

2. Description of the Related Art

In a method known as conventional color photography, a color photosensitive material for photographing use (the so-called color negative film) generally comprises a layer capable of recording blue light to form a yellow image, a layer capable of recording green light to form a magenta image and a layer capable of recording red light to form a cyan images. When such a material undergoes development-processing after exposure, the silver halide grains having latent images formed by the exposure are reduced to silver, while the developing agent is oxidized. The oxidized developing agent reacts with dye-providing couplers (that is, undergoes coupling reaction) to form dye images. From the resultant material, the undeveloped silver halide and the developed silver are removed in a bleach-fix step subsequent to the development step, thereby obtaining a color negative film in which dye images are formed.

Conventionally, the negative dye images of the color negative film are projected onto a color photosensitive material for printing use, and the thus exposed printing material is subjected to development and bleach-fix steps similar to the above, thereby obtaining a color print.

Also, another method of forming color images in a printing material is known, wherein the image information present in a color negative as described above is read by a photoelectric means, and subjected to image processing to be converted into image data for recording, based on which images are formed on a different printing material. In particular, the development of digital photoprinters has been advanced as an embodiment of the foregoing method. An example of such photoprinters is described in JP-A-7-015593. In a digital photoprinter, the image data are converted into digital signals, and laser light modulated in accordance with those digital signals is used for scanning exposure of photosensitive materials, such as color paper, to provide finished prints.

The methods cited above presuppose usual development, bleach and fixation steps (wet processing steps), and so their processing steps are complex.

Also, use of processing solutions and the like involves troublesome management thereof and a solution stain on an apparatus which shortens the service life of the apparatus.

SUMMARY OF THE INVENTION

In view of the foregoing fact, an object of the present invention is to provide a photosensitive material processing apparatus which can form images on an exposed photosensitive material through a simple development process, while improving the maintainability thereof.

According to a first aspect of the present invention, there is provided a photosensitive material processing apparatus which comprises a heating drum, and a processing member which is housed in a rolled form and an unwound portion of which is pressed against the circumference of the heating drum, wherein an image is formed on the heat-development-type photosensitive material by transporting and heating the heat-development-type photosensitive material in a state in which it is sandwiched between the heating drum and the unwound portion of the processing member and is superimposed on the unwound portion of the processing member.

In the photosensitive material processing apparatus according to the first aspect of the present invention, the heat-development-type photosensitive material on which images have been recorded through exposure is transported and heated in a state in which it is sandwiched between the heating drum and the unwound portion of the processing member and is superimposed on the unwound portion of the processing member.

The processing member is a member which is superimposed on the heat-development-type photosensitive material to thereby form images on the heat-development-type photosensitive material through application of heat. Therefore, through the application of heat to the superimposed heat-development-type photosensitive material and processing member, the images are formed on the exposed photosensitive material.

In this way, the images recorded on the photosensitive material through exposure can be developed in a simple manner without conventional troublesome developing, bleaching, and fixing being carried out. Also, since liquid which includes a processing solution or a like agent is not used, a user is not burdened with the troublesome storage and replenishment control of such solutions and the cleaning of the apparatus, thereby obtaining improved maintainability of the apparatus for image formation.

The materials according to second and third aspects of the present invention can be used as the heat-development-type photosensitive material and the processing member, respectively.

That is, according to the second aspect of the present invention, in the photosensitive material processing apparatus according to the first aspect, the heat-development-type photosensitive material comprises a support and at least three light-sensitive layers provided thereon which have their individual sensitivities in different wavelength regions. Each of the layers comprising light-sensitive silver halide, a binder, and a coloring material capable of releasing or dispersing a diffusible dye imagewise. The coloring materials of the respective layers will have different hues after development. The processing member comprises a support and at least a layer provided thereon and including a mordant.

As the heat-development-type photosensitive material and the processing member used in the photosensitive material processing apparatus in accordance with the second aspect, the following materials and members disclosed in EP 762201 A1 can be used.

The heat-development-type photosensitive material used in the present invention comprises a support provided thereon at least three light-sensitive layers which have their individual sensitivities in different wavelength regions, each of the layers comprising light-sensitive silver halide, a binder, and a nondiffusible coloring material capable of releasing a diffusible dye responding positively or negatively to silver development. The coloring materials of the respective layers will have different hues after development.

The three light-sensitive layers are preferably sensitive to blue light, green light, and red light, respectively. In general, a red-light-sensitive layer, a green-light-sensitive layer, and a blue-light-sensitive layer are provided, in this sequence from the support-side. However, they may be layered in a sequence different from the above-described sequence depending on the purpose of the heat-development-type photosensitive material. For example, they may be layered in the sequence described on column 162 in JP-A-7-0152129. Each of the light-sensitive layers may be divided into a plurality of silver-halide emulsion layers that have substantially the same color sensitivity but that have different sensitivities.

There can be freely determined the relationship between layers in terms of spectral sensitivity and hues of the diffusible dyes. However, when cyan, magenta and yellow coloring materials are used for the red, green and blue light-sensitive layers, respectively, writing images onto a conventional color paper or the like becomes easier.

In addition to the above-described silver-halide emulsion layer, there may be provided various kinds of light-insensitive layers such as a protective layer, an undercoat layer, an intermediate layer, a yellow filter layer, and an anti-halation layer. Also, various kinds of auxiliary layers such as a backing layer may be provided on the opposite side of the support. Moreover, a magnetic recording layer may be added.

No restriction is imposed on silver halides usable for the heat-development-type photosensitive material. Examples of such silver halides includes silver chloride, silver iodochloride, silver chlorobromide, silver chloroiodobromide, silver iodobromide, and silver bromide. The content of the silver iodide is preferably not greater than 10 Mol %, more preferably not greater than 1 Mol %, and particularly preferably not greater than 0.5 Mol %. Silver halide emulsions used in the present invention may be those of surface latent image type or those of internal latent image type. The emulsions of the internal latent image type are combined with a nucleating agent or fogging with light, and thereby they are used as direct reversal emulsions. Also, they may be the so-called core/shell emulsions comprising grains which differ in phase between the inner part and the surface layer thereof. Further, silver halide phases different in composition may be fused together by forming an epitaxial junction. As for the crystal habit, silver halide grains may have a regular crystal form which includes no twinned crystal planes, a single twined crystal form which includes a single pair of twined crystal planes, a parallel-multi-twined crystal form which includes two or more pairs of twined parallel crystal planes, a nonparallel-multi-twined crystal form which includes two or more pairs of twined nonparallel crystal planes, a spherical crystal form, a potato-like crystal form, a tablet-shaped crystal form having a high aspect ratio, or a composite form thereof. These forms may be selectively used in accordance with the intended purpose. The shape of twined crystal grains is described in *Shashin Kogaku no Kiso—Ginen Shashin Hen* (which means "The fundamental of Photographic Engineering—The volume of Silver Salt Photography"), page 163, compiled by Japanese Photographic Society, published by Corona Publishing Co., Ltd. The silver halide grains may be grains having any size, ranging from fine grains each having an average diameter of 0.05 μm or less to large grains each having a diameter of 10 μm or more measured in its projected area. Preferably, the grain size falls within the range of 0.1 to 2 μm, particularly 0.1 to 0.9 μm.

The silver halide emulsions used may be of a monodisperse type having a narrow grain size distribution or of a polydisperse type. Monodisperse type silver halide emulsions have a grain size distribution in which 80% or more of grains are included within the range of ±30% of the average grain size in terms of number of grains or weight. Moreover, as described in JP-A-1-167743 and JP-A-4-223463, it is desirable to use together two more kinds of monodisperse type silver halide emulsions that have substantially the same color sensitivity but that have different grain sizes. The two or more kinds of emulsions may be mixed in a common layer or may form different layers. Two or more kinds of polydisperse type silver halide emulsions, or a combination of a monodisperse type silver halide emulsion and a polydisperse type silver halide emulsion may be used. Methods for preparing silver halide emulsions are described in P. Glafkides, Chimie et Physique Photographique Paul Montel, 1967; G. F. Duffin, Photographic Emulsion Chemistry, Focal Press, 1966; and V. L. Zelikman et al. Making and Coating Photographic Emulsion, Focal Press, 1964.

One or more kinds of metallic salts (including complex salts) may be added during the step of grain formation or physical aging of the silver halide. Examples of such metallic salts include salts and complex salts of precious metals and heavy metals such as cadmium, zinc, lead, thallium, iridium, platinum, palladium, osmium, rhodium, chromium, ruthenium, and rhenium. These compounds may be used singly or in combination of two or more kinds. These compounds are added in an amount of about $10^{-9}$ to $10^{-3}$ Mol per one Mol of silver halide.

In the present invention, light-sensitive silver halide emulsions may be used while they are not chemically sensitized,-but are, in general, chemically sensitized silver halide emulsions. In chemically sensitizing silver halide emulsions used in the present invention, known chemical sensitization processes for emulsions of general photosensitive materials, such as a chalcogen sensitization process, including a sulfur sensitization process, a selenium sensitization process and a tellurium sensitization process, a precious metal sensitization process using gold, platinum, palladium or the like, and a reduction sensitization process, can be employed alone or in combination of two or more thereof (as described, e.g. in JP-A-3-110555 and JP-A-4-75798). Such chemical sensitization can be also carried out in the presence of a nitrogen-containing heterocyclic compound (as described in JP-A-62-253159). Further, an antifoggant recited hereinafter can be added after the conclusion of chemical sensitization. The addition of an antifoggant can be performed in the ways as described in JP-A-5-45833 and JP-A-62-40446.

The present Invention uses nondiffusible coloring materials capable of releasing diffusible dyes responding positively or negatively to silver development. These coloring materials can be represented by the following general formula (LI):

$$((\mathrm{Dye})_m\text{–}Y)_n\text{–}Z \qquad [L1]$$

wherein Dye represents a diffusible dye moiety, Y represents merely a linkage group, Z represents a group having the property of enabling the imagewise release of a diffusible moiety $(\mathrm{Dye})_m$–Y in positive or negative response to a latent image formed in the light-sensitive silver halide and, at the same time, rendering the coloring material (LI) itself nondiffusible, m is an integer of from 1 to 5, and n is an integer of 1 or 2. When neither m nor n is 1, a plurality of Dye moieties may be the same or different.

Specific examples of a coloring material of the foregoing formula (LI) include the compounds classified into the following Groups (1) to (4). Additionally, the compounds classified as Groups (1) to (3) have the property of releasing a diffusible dye responding negatively to the development of silver halide, and the compounds classified as Group (4) have the property of releasing a diffusible dye responding positively to the development of silver halide.

The Group (1) includes the dye developers which each contain a hydroquinone developer attached to a dye moiety, as described, e.g., in U.S. Pat. Nos. 3,134,764, 3,362,819, 3,597,200, 3,544,545 and 3,482,972, and JP-B-3-68387. These dye developers are diffusible under an alkaline condition, but become nondiffusible by the reaction with silver halide.

The Group (2) includes, as described, e.g., in U.S. Pat. No. 4,503,137, nondiffusible compounds of the type which have a capability of releasing a diffusible dye under an alkaline condition but lose the capability by reacting with silver halide. As examples of such compounds, mention may be made of the compounds which release diffusible dyes by the intramolecular nucleophilic substitution reaction, as described, e.g., in U.S. Pat. No. 3,980,479; and the compounds which release diffusible dyes by the intramolecular rearrangement reaction of an isooxazolone ring, as described, e.g., in U.S. Pat. No. 4,199,354.

The Group (3) includes, as described, e.g., in U.S. Pat. No. 4,559,290, EP-A2-0220746, U.S. Pat. No. 4,783,396, Kokai Giho 87-6199 and JP-A-64-13546, nondiffusible compounds of the type which release diffusible dyes by the reaction with a reducing agent remaining without undergoing oxidation upon development.

As examples of such compounds, mention may be made of the compounds which, after undergoing the reduction, release diffusible dyes by the intramolecular nucleophilic substitution reaction, as described, e.g., in U.S. Pat. Nos. 4,139,389 and 4,139,379, JP-A-59-185333 and JP-A-57-84453; the compounds which, after undergoing reduction, release diffusible dyes by the intramolecular electron transfer reaction, as described, e.g., in U.S. Pat. No. 4,232,107, JP-A-59-101649, JP-A-61-88257 and Research Disclosure (abbreviated as "RD", hereinafter) No. 24,025 (1984); the compounds which, after undergoing reduction, release diffusible dyes by the single bond cleavage, as described, e.g., in West German Patent 3,008,588 A, JP-A-56-142530, and U.S. Pat. Nos. 4,343,893 and 4,619,884; the nitro compounds which release diffusible dyes after electron acceptance, as described, e.g., in U.S. Pat. No. 4,450,223; and the compounds which release diffusible dyes after electron acceptance, as described, e.g., in U.S. Pat. No. 4,609,610.

Further, the compounds described in EP-A2-0220746, Kokai Giho 87-6199, U.S. Patent 4,783,396, JP-A-63-201653, JP-A-63-201654, JP-A-64-13546 and so on, which each have both N-X bond (X represents an oxygen, sulfur or nitrogen atom) and electron-attracting group; the compounds described in JP-A-1-26842, which each have both $SO_2$—X bond (X has the same meaning as the above) and electron-attracting group; the compounds described in JP-A-63-271344, which each have both PO-X bond (X has the same meaning as the above) and electron attracting group; and the compounds described in JP-A-63-271341, which each have both C-X' bond (X' has the same meaning as X, or represents —$SO_2$—) and electron-attracting group are more appropriate for the Group (3) compounds. In addition, the compounds described in JP-A-1-161237 and JP-A-1-161342, which each release a diffusible dye as a result of the cleavage of a single bond caused by the π-bond conjugated with an electron-accepting group after reduction, can also be employed.

Of those compounds, the compounds having both N-X bond (X=O, S or N) and electron-attracting group in each molecule are preferred over the others. Specific examples thereof include Compounds (1)–(3), (7)–(10), (12), (13), (15), (23)–(26), (31), (32), (35), (36), (40), (41), (44), (53)–(59), (64) and (70) described in EP-A2-0220746 or U.S. Pat. No. 4,783,396, Compounds (11)–(23) described in Kokai Giho 87-6199, and Compounds (1)–(84) described in JP-A-64-13546.

The Group (4) includes compounds of the type which can cause reduction in silver halide or an organosilver salt and release diffusible dyes when silver halide or an organosilver salt is reduced thereby (DRR compounds). These compounds have an advantage in that they can prevent images from being stained by oxidative decomposition products of a reducing agent since they don't require any other reducing agents. The representatives thereof are described, e.g., in U.S. Pat. Nos. 3,928,312, 4,053,312, 4,055,428 and 4,336,322, JP-A-59-65839, JP-A-59-69839, JP-A-53-3819, JP-A-51-104343, RD No. 17465, U.S. Pat. Nos. 3,725,062, 3,728,113 and 3,443,939, JP-A-58-116537, JP-A-57-179840, and U.S. Pat. No. 4,500,626. Specific examples of a DDR compound include the compounds described on columns 22 to 44 in the above-cited U.S. Pat. No. 4,500,626. Of these compounds, Compounds (1)–(3), (10)–(13), (16)–(19), (28)–(30), (33)–(35), (38)–(40) and (42)–(64) illustrated in the foregoing U.S. Patent are preferred over the others. In addition, the compounds illustrated on columns 37–39 in U.S. Pat. No. 4,639,408 are also useful.

It is preferable to incorporate a reducing agent in the heat-development-type photosensitive material. In this case, reducing agents known in the field of heat-development-type photosensitive materials can be used. In addition, the coloring material may function as a reducing agent, too. Further, it is possible to use precursors of a reducing agent, or compounds which themselves have no reducing power, but can acquire a reducing power when a nucleophilic reagent or heat acts thereon in the development step. Specific examples of a reducing agent which can be used in the present invention include the reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A-60-140335 (pages 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JA-A-64-13546 (pages 40–57), JP-A-1-120553, and EP-A2-0220746 (pages 7–96). Also, the combinations of various reducing agents as disclosed in U.S. Pat. No. 3,039,869 can be used.

When a nondiffusible reducing agent is used, an electron transmitting agent or/and a precursor thereof can optionally be used together therewith in order to promote the electron transfer between the nondiffusible reducing agent and a developable silver halide. In particular, those agents described in U.S. Pat. No. 5,139,919 cited above and EP-A-0418743 are used to advantage. Further, it is desirable to adopt the methods of introducing such agents stably into layers, as described in JP-A-2-230143 and JP-A-2-235044.

The electron transmitting agent and the precursor thereof can be selected from the above-recited reducing agents and their precursors. For the electron transmitting agent or the precursor thereof, it is desirable that its mobility be greater than that of a nondiffusible reducing agent (electron donor). Especially useful electron transmitting agents are 1-phenyl-3-pyrazolidones or aminophenols.

The nondiffusible reducing agent (electron donor) used in combination with an electron transmitting agent can be a reducing agent selected from the above-recited reducing agents, provided that the selected one does not have substantial mobility in constituent layers of a photosensitive material. Suitable examples of such a reducing agent include hydroquinones, sulfonamidophenols, sulfonamidonaphthols, the compounds described as electron donors in JP-A-53-110827 and U.S. Pat. Nos. 5,032,487, 5,026,634 and 4,839,272, and the dye-providing compounds having diffusion resistance and reducing power, which are described hereinafter.

In addition, the electron donor precursors as described in JP-A-3-160443 are also used to advantage.

Further, the above-described reducing agents can be used in intermediate layers and protective layers for various purposes, including the prevention of colors from mixing and the improvement in color reproduction. Suitable examples of such a reducing agent include those described in EP-A-0524649, EP-A-0357040, JP-A-2-249245, JP-A-2-46450 and JP-A-63-186240. In addition, the development inhibitor releasing reducer compounds as described in JP-B-3-63733, JP-A-1-150135, JP-A-2-46450, JP-A-2-64634, JP-A-3-43735 and EP-A-0451833 can also be employed.

In the present invention, organometal salts can be used as oxidizer together with light-sensitive silver halide. Of organometal salts, organosilver salts are preferred in particular. As for the organic compounds usable for forming organosilver salt oxidizers, the benzotriazoles described, e.g. on columns 52–53 in U.S. Pat. No. 4,500,626, and fatty acids are examples thereof. In addition, the acetylene silver described in U.S. Pat. No. 4,775,613 is also useful. Organosilver salts may be used as a mixture of two or more thereof. Those organosilver salts can be used in an amount of from 0.01 to 10 moles, preferably from 0.01 to 1 mole, per mole of light-sensitive silver halide. An appropriate total coverage of light-sensitive silver halide and organosilver salts is in the range of 0.05 to 10 g/m$^2$, preferably 0.1 to 4 g/m$^2$, based on silver.

As for the binder used in constituent layers of the photosensitive material, hydrophilic binders are preferred. As examples of such a binder, mention may be made of those described in RD, supra, and those described at pages 71–75 of JP-A-64-13546. Specifically, transparent or translucent hydrophilic binders are desirable, and examples thereof include natural compounds, for example, proteins, such as gelatin and gelatin derivatives, and polysaccharides, such as cellulose derivatives, starch, gum arabic, dextran and pulluran, as well as synthetic high molecular compounds, such as polyvinyl alcohol, polyvinyl pyrrolidone and acrylamide polymers. Further, it is possible to use as the binder the highly water-absorbing polymers described, e.g. in U.S. Pat. No. 4,960,681 and JP-A-62-245260. More specifically, those polymers are homo- or copolymers of vinyl monomers having —COOM or —$SO_3$M (wherein M is a hydrogen atom or an alkali metal), such as sodium methacrylate and ammonium methacrylate, and copolymers of a vinyl monomer having the foregoing group and other vinyl monomers (e.g., Sumikagel L-5H, trade name, a product of Sumitomo Chemical Co., Ltd.). The binders recited above can be used as combination of two or more thereof. In particular, it is desirable to combine gelatin with some of the foregoing binders. As for the gelatin, lime-processed gelatin, acid-processed gelatin or delimed gelatin having reduced contents of calcium and the like may be properly chosen depending on the intended purpose. Also, it is desirable that those gelatins be used in combination.

An appropriate binder coverage in the present invention is 1 to 20 g/m$^2$, particularly 2 to 10 g/m$^2$.

In the heat-development-type photosensitive material, it is desirable to use a base or its precursor for the purpose of promoting the silver development and the dye formation. As for the precursors of bases, there are known the salts formed by bases and organic acids capable of undergoing decarboxylation upon heating, and the compounds capable of releasing amines by intramolecular nucleophilic substitution reaction, Lossen rearrangement or Beckmann rearrangement. Specific examples of such precursors of bases are described in U.S. Pat. Nos. 4,514,493 and 4,657,848, and *Kochi Gijutsu* No. 5, pp. 55–86 (published in May 22, 1991, by Azutec Company Inc.). As described in EP-A-0210660 and U.S. Pat. No. 4,740,445, it is effective to adopt the method of producing a base by the use of the combination of a basic metal compound slightly soluble in water with the so-called complexing compound, or a compound capable of complexing the metal ion, which constitutes the basic metal compound, in water as a medium.

To the heat-development-type photosensitive material, a thermal solvent may further be added for the purpose of promoting the heat development. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethyl urea), the sulfonamide derivatives (such as the compounds described in JP-B-1-40974 and JP-B-4-13701), polyol compounds (such as sorbitols) and polyethylene glycols can be used as thermal solvent. When a thermal solvent used is insoluble in water, it is desirable for the solvent to be used in the form of solid dispersion. The layer to which a thermal solvent is added may be chosen from light-sensitive layers or light-insensitive layers depending on the intended purpose.

Supports for the heat-development-type photosensitive material are chosen from those which can withstand processing temperatures. In general, photographic supports, including various types of paper and synthetic polymer films, as described in *Shashin Kogaku no Kiso—Gin-en Shashin Hen* (which means "Fundamentals of Photographic Engineering—The Volume of Silver Salt Photography"), pages 223–240, compiled by Japanese Photographic Society, published by Corona Publishing Co., Ltd. In 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose) These films can be used alone, or a film laminated with a synthetic polymer such as polyethylene on one side or both sides can be used as a support. Other supports which can be employed are those described, e.g., in JP-A-62-253159 (pages 29–31), JP-A-1-161236 (pages 14–17), JP-A-63-316848, JP-A-2-22651, JP-A-3-56955, and U.S. Pat. No. 5,001,033.

In particular, the supports described in JP-A-6-41281, JP-A-6-43581, JP-A-6-51426, JP-A-6-51437, JP-A-6-51442, and Japanese Patent Application Nos. 4-251845, 4-231825, 4-253545, 4-258828, 4-240122, 4-221538, 5-21625, 5-15926, 4-331928, 5-199704, 6-13455 and 6-14666 can be appropriate for the photosensitive material because of their excellent anticurling properties. Also, the support constituted mainly of a syndiotactic styrene polymer can be used to advantage.

Known photographic additives that can be used in the heat-development-type photosensitive material are described in the above-cited RD No. 17,643, RD No. 18,716, and RD No. 307,105. The following is a list of those additives and the locations of their descriptions in the above cited reference.

| Additives | RD 17643 | RD 18716 | RD 307105 |
|---|---|---|---|
| 1. Chemical Sensitizer | p. 23 | p. 648, right column | p. 866 |
| 2. Sensitivity Rising Agent | | p. 648, right column | |
| 3. Spectral Sensitizer, and Supersensitizing Agent | pp. 23–24 | p. 648, right column, to p. 649, right column | pp. 866–868 |
| 4. Brightening Agent | p. 24 | p. 648, right column | p. 868 |
| 5. Antifoggant and Stabilizer | pp. 24–26 | p. 649, right column | pp. 868–870 |
| 6. Light Absorbent, Filter Dye, and UV Absorbent | pp. 25–26 | p. 649, right column, to p. 650, left column | p. 873 |
| 7. Dye Image Stabilizer | p. 25 | p. 650, left column | p. 872 |
| 8. Hardener | p. 26 | p. 651, left column | pp. 874–875 |
| 9. Binder | p. 26 | p. 651, left column | pp. 873–874 |
| 10. Plasticizer, and Lubricant | p. 27 | p. 650, right column | p. 876 |
| 11. Coating Aid, and Surfactant | pp. 26–27 | p. 650, right column | pp. 875–876 |
| 12. Antistatic Agent | p. 27 | p. 650, right column | pp. 876–877 |
| 13. Matting Agent | | | pp. 878–879 |

Next, a description will be given of a processing member used in the present invention. The processing member has a layer (a processing layer) which contains mordants so as to capture dyes diffusing from the heat-development-type photosensitive material during heat development. As for the form which the processing layer may take, that layer and the photosensitive material may have separate supports or the same support. However, the form of having separate supports is preferred. As for the mordant, those known in the photographic arts can be employed, with specific examples including the mordants described in U.S. Pat. No. 4,500,626 (on columns 58–59) and JP-A-61-88256 (at pages 32–41), and those described in JP-A-62-244043 and JP-A-62-244036. Further, the dye-accepting high molecular compounds as described in U.S. Pat. No. 4,463,079 may be used. As for the binder of a processing layer, the same binder used in the photosensitive material can be employed. In addition, it is useful to provide the processing layer with a protective layer.

The processing layer of the processing member may contain a base or its precursor for the purpose required for development. For example, in the case where there is used the above-described method of producing a base by the use of the combination of a basic metal compound slightly soluble in water with the complexing compound, the basic metal compound slightly soluble in water is added to the constituent layers of the heat-development-type photosensitive material, whereas the complexing compound is added to the processing layer of the processing member. During heat development, a small amount of water is supplied to the heat-development-type photosensitive material or the processing member, and they are subsequently superimposed on one another. Through this operation, a base is produced. Moreover, to the processing layer of the processing member, a thermal solvent may further be added for the purpose of promoting the heat development and of the removal of unnecessary substances.

Next, a description will be given of a heat-development step. In the present invention, when the light-sensitive layer of an-exposed heat-development-type photosensitive material and the processing member are superposed on one another and heat is applied to them, exposed silver halide is developed, and diffusible dyes are released responding positively or negatively to the development. The diffusible dyes are moved to the processing member and fixed thereto, so that color images are formed on the heat-development-type photosensitive material by the remaining coloring materials.

The heating temperature for the heat development step is in the range of about 50° C. to 250° C., preferably 60° C. to 150° C.

In the heat-development step, a small amount of solvent may be used in order to promote development, transfer of a processing substance, and diffusion of an unnecessary substance. Specific examples are described, e.g., in U.S. Pat. No. 4,704,245, U.S. Pat. No. 4,470,445 and JP-A-61-238056. Examples of such solvents include water, a basic water solution containing an inorganic alkali metal slat or an organic bases (examples of those bases includes those recited in the description of an image formation accelerator), low boiling solvents, and mixed solution of low boiling solvents with water or the above-described basic water solution. Further, those solvents may contain a surfactant, an antifoggant, a compound with which a sparingly soluble metal salt can be complexed, antimolds, and anitbacterial agents. The weight of a solvent used is determined equal to or less than the weight of a solvent corresponding to the maximum swelling volume of all the applied layers. In this method, the heating temperature is preferably not greater than the boiling point of a solvent used. In the case of using water as the solvent, a desirable heating temperature is from 50° C. to 100° C.

As the solvent used in the heat-development step, water is preferred, and any types of water may be employed. Specifically, distilled water, tap water, well water, mineral water and so on can be used. Water may be used only once and then discarded, or water may be circulated and used repeatedly. Water can be supplied to the heat-development-type photosensitive material or the processing member or both. As for the method of supplying water, the methods described, e.g. in JP-A-62-253159 (page 5) and JP-A-63-85544 are used to advantage. In addition, it is possible to adopt the method in which a solvent previously microencapsulated or made into the form of hydrate is incorporated into the photosensitive material or the processing member or both. The temperature of the supplied water is adequately from 30° C. to 60° C., as described in JP-A-63-85544 cited above.

When the heat development is carried out while water is used as a solvent, as described in EP-A-0210660 and U.S. Pat. No. 4,740,445, it is effective to adopt the method of producing a base by the use of the combination of a basic metal compound slightly soluble in water with the so-called complexing compound, or a compound capable of completing the metal ion, which constitutes the basic metal compound, in water as a medium. In this case, it is preferred from the viewpoint of raw stock storability that the basic metal compound slightly soluble in water be added to the photosensitive material, and the completing compound be added to the processing member.

According to the third aspect of the present invention, in the photosensitive material processing apparatus according to the first aspect, the heat-development-type photosensitive material comprises a support provided thereon at least three light-sensitive layers which have their individual sensitivities in different wavelength regions. Each of the layers comprising light-sensitive silver halide, a binder, and a dye-providing coupler. The dyes formed from dye-providing couplers in the layers are different in hue.

In the photosensitive material processing apparatus according to the third aspect, the following materials and members disclosed in EP 762201 A1 can be used as the heat-development-type photosensitive material and the processing member.

The heat-development-type photosensitive material comprises a support provided thereon at least three light-sensitive layers which have their individual sensitivities in different wavelength regions. Each of the layers comprising light-sensitive silver halide, a binder, and a dye-providing coupler, and the dyes formed from dye-providing couplers in the layers are different in hue. Also, it is preferred that the photosensitive material contain a developing agent that reacts with the dye-providing couplers so as to form dyes.

The three light-sensitive layers are preferably sensitive to blue light, green light, and red light, respectively. In general, a red-light-sensitive layer, a green-light-sensitive layer, and a blue-light-sensitive layer are provided, in this sequence from the support-side. However, they may be layered in a sequence different from the above-described sequence depending on the purpose of the heat-development-type photosensitive material. For example, they may be layered in the sequence described on column 162 in JP-A-7-0152129. Each of the light-sensitive layers may be divided into a plurality of silver-halide emulsion layers that have substantially the same color sensitivity but that have different sensitivities.

There can be freely determined the relationship between layers in terms of spectral sensitivity and hues of the diffusible dyes. However, when cyan, magenta and yellow coloring materials are used for the red, green and blue light-sensitive layers, respectively, writing images onto a conventional color paper or the like becomes easier.

In addition to the above-described silver-halide emulsion layer, there may be provided various kinds of light-insensitive layers such as a protective layer, an undercoat layer, an intermediate layer, a yellow filter layer, and an anti-halation layer. Also, various kinds of auxiliary layers such as a backing layer may be provided on the opposite side of the support. Moreover, a magnetic recording layer may be added.

Both four-equivalent couplers and two-equivalent couplers can be used as dye-providing couplers in the present invention. Their nondiffusible groups may have the form of a polymer chain. Specific examples of such couplers are described in detail in T. H. James, *The Theory of the Photographic Process,* 4th edition, pages 291–334 and 354–361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, and Japanese Patent Application Nos. 6-270700, 6-307049 and 6-312380.

In order to shorn development time and to improve sensitivity and image density, the photosensitive material used in the present invention preferably contains a color developing agent that allows oxidation products formed by silver development to couple with the above-described coupler so as to produce dyes.

For example, the combination of a p-phenylene diamine developing agent and an activated methylene coupler described in U.S. Pat. No. 3,531,256 or the combination of a p-aminophenol developing agent and an activated methylene coupler described in U.S. Pat. No. 3,761,270 can be used. When the combination of sulfonamide phenol and a four-equivalent coupler as described, e.g., in U.S. Pat. No. 4,021,240 and JP-A-60-128438 is employed for the photosensitive material, an excellent raw stock storability can be realized. Therefore, this combination is preferred. When a color developing agent is included-in the photosensitive material, a precursor of the color developing agent may be used. Examples of such a precursor include the indoaniline compounds described in U.S. Pat. No. 3,342,597, the Schiff base type compounds described in U.S. Pat. No. 3,342,599, and RD Nos. 14,850 and 15,159, the aldol compound described in RD No. 13,924, the metallic salt complex described in U.S. Pat. No. 3,719,492, and the urethane compounds described in JP-A-53-135628. Also, the combination of a coupler and the sulfonamide phenol developing agent disclosed in the Japanese Patent Application No. 7-180568 or the hydrazine developing agent described in Japanese Patent Application Nos. 7-49287 and 7-63572 is preferably used for the photosensitive material of the present invention.

Although the silver halide, the dye-providing coupler, and the developing agent may be included in a common layer, they may be added separately to different layers. For example, when the developing agent and the silver halide are included in different layers, raw stock storability can be improved.

In the present invention, organometal salts can be used as oxidizer together with light-sensitive silver halide. of organometal salts, organosilver salts are preferred in particular. As for the organic compounds usable for forming organosilver salt oxidizers, the benzotriazoles described, e.g. on columns 52–53 in U.S. Pat. No. 4,500,626, and fatty acids are examples thereof. In addition, the acetylene silver described in U.S. Pat. No. 4,775,613 is also useful. Organosilver salts may be used as a mixture of two or more thereof. Those organosilver salts can be used in an amount of front 0.01 to 10 moles, preferably from 0.01 to 1 mole, per mole of light-sensitive silver halide. An appropriate total coverage of light-sensitive silver halide and organosilver salts is in the range of 0.05 to 10 $g/m^2$, preferably 0.1 to 4 $g/m^2$, based on silver.

As for the binder used in constituent layers of the photosensitive material, hydrophilic binders are preferred. As examples of such a binder, mention may be made of those described in RD, supra, and those described at pages 71–75 of JP-A-64-13546. Specifically, transparent or translucent hydrophilic binders are desirable, and examples thereof include natural compounds, for example, proteins, such as gelatin and gelatin derivatives, and polysaccharides, such as cellulose derivatives, starch, gum arabic, dextran and pulluran, as well as synthetic high molecular compounds, such as polyvinyl alcohol, polyvinyl pyrrolidone and acrylamide polymers. Further, it is possible to use as the binder the highly water-absorbing polymers described, e.g. in U.S. Pat. No. 4,960,681 and JP-A-62-245260. More specifically, those polymers are homo- or copolymers of vinyl monomers having —COOM or —$SO_3M$ (wherein M is a hydrogen atom or an alkali metal), such as sodium methacrylate and ammonium methacrylate, and copolymers of a vinyl monomer having the foregoing group and other vinyl monomers (e.g., Sumikagel L-5H, trade name, a product of Sumitomo Chemical Co., Ltd.). The binders-recited above can be used as combination of two or more thereof. In particular, it is desirable to combine gelatin with some of the foregoing binders. As for the gelatin, lime-processed gelatin, acid-processed gelatin or delimed gelatin having reduced contents of calcium and the like may be properly chosen depending on the intended purpose. Also, it is desirable that those gelatins be used in combination.

An appropriate binder coverage in the present invention is 1 to 20 g/$m^2$, particularly 2 to 10 g/$m^2$.

When a nondiffusible developing agent is used, an electron transmitting agent or/and a precursor thereof can optionally be used together therewith in order to promote the electron transfer between the nondiffusible developing agent and a developable silver halide. In particular, those agents described in U.S. Pat. No. 5,139,919 and EP-A-0418743 are used to advantage. Further, it is desirable to adopt the methods of introducing such agents stably into layers, as described in JP-A-2-230143 and JP-A-2-235044. The electron transmitting agent and the precursor thereof can be selected from the above-recited developing agents and their precursors. For the electron transmitting agent or the precursor thereof, it is desirable that its mobility be greater than that of a nondiffusible developing agent (electron donor). Especially useful electron transmitting agents are 1-phenyl-3-pyrazolidones or aminophenols. Also, electron-providing precursors as described in JP-A-3-160,433 are preferably used.

Further, various kinds of reducing agents can be used in intermediate layers and protective layers for various purposes, including the prevention of colors from mixing and the improvement in color reproduction. Suitable examples of such a reducing agent include those described in EP-A-0524649, EP-A-0357040, JP-A-2-249245, JP-A-2-46450 and JP-A-63-186240. In addition, the development inhibitor releasing reducer compounds as described in JP-B-3-63733, JP-A-1-150135, JP-A-2-46450, JP-A-2-64634, JP-A-3-43735 and EP-A-0451833 can also be employed.

In the heat-development-type photosensitive material, it is desirable to use a base or its precursor for the purpose of promoting the silver development and the dye formation. As for the precursors of bases, there are known the salts formed by bases and organic acids capable of undergoing decarboxylation upon heating, and the compounds capable of releasing amines by intramolecular nucleophilic substitution reaction, Lossen rearrangement or Beckmann rearrangement. Specific examples of such precursors of bases are described in U.S. Pat. Nos. 4,514,493 and 4,657,848, and *Kochi Gijutsu* No. 5, pp. 55–86 (published in May 22, 1991, by Azutec Company Inc.). As described in EP-A-0210660 and U.S. Pat. No. 4,740,445, it is effective to adopt the method of producing a base by the use of the combination of a basic metal compound slightly soluble in water with the so-called complexing compound, or a compound capable of complexing the metal ion, which constitutes the basic metal compound, in water as a medium.

To the heat-development-type photosensitive material, a thermal solvent may further be added for the purpose of promoting the heat development. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethyl urea), the sulfonamide derivatives (such as the compounds described in JP-B-1-40974 and JP-B-4-13701), polyol compounds (such as sorbitols) and polyethylene glycols can be used as thermal solvent. when a thermal solvent used is insoluble in water, it is desirable for the solvent to be used in the form of solid dispersion. The layer to which a thermal solvent is added may be chosen from light-sensitive layers or light-insensitive layers depending on the intended purpose.

Supports for the heat-development-type photosensitive material are chosen from those which can withstand processing temperatures. In general, photographic supports, including various types of paper and synthetic polymer films, as described in *Shashin Kogaku no Kiso—Gin-en Shashin Hen* (which means "Fundamentals of Photographic Engineering—The Volume of Silver Salt Photography"), pages 223–240, compiled by Japanese Photographic Society, published by Corona Publishing Co., Ltd. In 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose) These films can be used alone, or a film laminated with a synthetic polymer such as polyethylene on one side or both sides can be used as a support. Other supports which can be employed are those described, e.g., in JP-A-62-253159 (pages 29–31), JP-A-1-161236 (pages 14–17), JP-A-63-316848, JP-A-2-22651, JP-A-3-56955, and U.S. Pat. No. 5,001,033.

In particular, the supports described in JP-A-6-41281, JP-A-6-43581, JP-A-6-51426, JP-A-6-51437, JP-A-6-51442, and Japanese Patent Application Nos. 4-251845, 4-231825, 4-253545, 4-258828, 4-240122, 4-221538, 5-21625, 5-15926, 4-331928, 5-199704, 6-13455 and 6-14666 can be appropriate for the photosensitive material because of their excellent anticurling properties. Also, the support constituted mainly of a syndiotactic styrene polymer can be used to advantage.

Known photographic additives that can be used in the heat-development-type photosensitive material are described in the above-cited RD No. 17,643, RD No. 18,716, and RD No. 307,105. The following is a list of those additives and the locations of their descriptions in the above cited reference.

| Additives | RD 17643 | RD 18716 | RD 307105 |
|---|---|---|---|
| 1. Chemical Sensitizer | p. 23 | p. 648, right column | p. 866 |
| 2. Sensitivity Rising Agent | | p. 648, right column | |
| 3. Spectral Sensitizer, and Supersensitizing Agent | pp. 23–24 | p. 648, right column, to p. 649, right column | pp. 866–868 |
| 4. Brightening Agent | p. 24 | p. 648, right column | p. 868 |

-continued

| Additives | RD 17643 | RD 18716 | RD 307105 |
|---|---|---|---|
| 5. Antifoggant and Stabilizer | pp. 24–26 | p. 649, right column | pp. 868–870 |
| 6. Light Absorbent, Filter Dye, and UV Absorbent | pp. 25–26 | p. 649, right column, to p. 650, left column | p. 873 |
| 7. Dye Image Stabilizer | p. 25 | p. 650, left column | p. 872 |
| 8. Hardener | p. 26 | p. 651, left column | pp. 874–875 |
| 9. Binder | p. 26 | p. 651, left column | pp. 873–874 |
| 10. Plasticizer, and Lubricant | p. 27 | p. 650, right column | p. 876 |
| 11. Coating Aid, and Surfactant | pp. 26–27 | p. 650, right column | pp. 875–876 |
| 12. Antistatic Agent | p. 27 | p. 650, right column | pp. 876–877 |
| 13. Matting Agent | | | pp. 878–879 |

Next, a description will be given of a processing member used in the present invention. The processing member is prepared independent of the photosensitive material by providing a processing layer on a separate support. In the heat-development step, the processing member shuts off air during heat development, prevents volatilization of substances from the photosensitive material, supplies processing substances to the photosensitive material, and removes components (YF dye, AH dye, etc.) within the photosensitive material that become unnecessary after development and/or unnecessary components that are produced during development. When heat development is carried out, the processing material is superimposed on the light-sensitive layer of the photosensitive material, and heat is applied to them. As for the support and binder of a processing layer, the same support and binder used in the photosensitive material can be employed.

For the purpose of removing the above-described dyes and for other purposes, a mordant may be added to the processing layer of the processing member. As for the mordant, those known in the photographic arts can be employed, with specific examples including the mordants described in U.S. Pat. No. 4,500,626 (on columns 58–59) and JP-A-61-88256 (at pages 32–41), and those described in JP-A-62-244043 and JP-A-62-244036. Further, the dye-accepting high molecular compounds as described in U.S. Pat. No. 4,463,079 may be used.

The processing layer of the processing member may contain a base or its precursor for the purpose required for development. For example, in the case where there is used the method of producing a base by the use of the combination of a basic metal compound slightly soluble in water with the complexing compound, the basic metal compound slightly soluble in water is added to the constituent layers of the heat-development-type photosensitive material, whereas the complexing compound is added to the processing layer of the processing member. During heat development, a small amount of water is supplied to the heat-development-type photosensitive material or the processing member, and they are subsequently superimposed on one another. Through this operation, a base is produced. Moreover, to the processing layer of the processing member, a thermal solvent may further be added for the purpose of promoting the heat development and of the removal of unnecessary substances.

Next, a description will be given of a heat-development step. In the present invention, when the light-sensitive layer of an exposed heat-development-type photosensitive material and the processing member are superposed on one another and heat is applied to them, exposed silver halide is developed, and resulting oxidation products of the developing agent and the dye-providing coupler carry out a color producing reaction so as to produce color images on the photosensitive material. The heating temperature for the heat development step is in the range of about 50° C. to 250° C., preferably 60° C. to 150° C.

In the heat-development step, a small amount of solvent may be used in order to promote development, transfer of a processing substance, and diffusion of an unnecessary substance. Specific examples are described, e.g., in U.S. Pat. No. 4,704,245, U.S. Pat. No. 4,470,445 and JP-A-61-238056. Examples of such solvents include water, a basic water solution containing an inorganic alkali metal slat or an organic bases (examples of those bases includes those recited in the description of an image formation accelerator), low boiling solvents, and mixed solution of low boiling solvents with water or the above-described basic water solution. Further, those solvents may contain a surfactant, an antifoggant, a compound with which a sparingly soluble metal salt can be complexed, antimolds, and anitbacterial agents. The weight of a solvent used is determined equal to or less than the weight of a solvent corresponding to the maximum swelling volume of all the applied layers. In this method, the heating temperature is preferably not greater than the boiling point of a solvent used. In the case of using water as the solvent, a desirable heating temperature is from 50° C. to 100° C.

As the solvent used in the heat-development step, water is preferred, and any types of water may be employed. Specifically, distilled water, tap water, well water, mineral water and so on can be used. Water may be used only once and then discarded, or water may be circulated and used repeatedly. Water can be supplied to the heat-development-type photosensitive material or the processing member or both. As for the method of supplying water, the methods described, e.g. in JP-A-62-253159 (page 5) and JP-A-63-85544 are used to advantage. In addition, it is possible to adopt the method in which a solvent previously microencapsulated or made into the form of hydrate is incorporated into the photosensitive material or the processing member or both. The temperature of the supplied water is adequately from 30° C. to 60° C., as described in JP-A-63-85544 cited above.

When the heat development is carried out while water is used as a solvent, as described in EP-A-0210660 and U.S. Pat. No. 4,740,445, it is effective to adopt the method of producing a base by the use of the combination of a basic metal compound slightly soluble in water with the so-called complexing compound, or a compound capable of complexing the metal ion, which constitutes the basic metal compound, in water as a medium. In this case, it is preferred from the viewpoint of raw stock storability that the basic metal compound slightly soluble in water be added to the photosensitive material, and the complexing compound be added to the processing member.

According to a fourth aspect of the present invention, in the photosensitive material processing apparatus according to any of the first to third aspects, there are further provided a processing member cassette in which aid processing member is housed in a rolled form, and an unwound portion of the processing member is exposed so as to be pressed against the circumference of the heating drum, and which includes a take-up unit for taking up the unwound portion of the processing member in a rolled form after the heat-development-type photosensitive material is transported while being held between the unwound portion of the processing member and the heating drum, the processing member cassette being removable from a processor body; and holding means for holding the processing member cassette such that it can move toward and away from the heating drum.

In the photosensitive material processing apparatus according to the fourth aspect, since the processing member cassette which contains the processing member is removable from the processor body, the processing member can be easily replaced or maintained. When the processing member cassette is loaded to the processor body, the processing member cassette is held in place by the holding means such that the processing member is reliably pressed against the heating drum.

According to a fifth aspect of the present invention, in the photosensitive material processing apparatus according to the fourth aspect, the processing member cassette comprises a holding projection for holding the unwound portion of the processing member in a curved state so as to adequately press the unwound portion against the circumference of the heating drum.

In the photosensitive material processing apparatus according to the fifth aspect, even when the processing member (the processing member cassette) is moved away from the circumference of the heating drum, the holding projection maintains the unwound portion of the processing member in a predetermined curved state. Therefore, when the processing member cassette is loaded to or unloaded from the processor body, the processing member becomes neither too slack nor too tight. Accordingly, when the processing member cassette is loaded to the processor body, the processing member is reliably pressed against the heating drum.

According to a sixth aspect of the present invention, in the photosensitive material processing apparatus according to the fourth or fifth aspect, the holding means brings the processing member cassette into contact with the heating drum only when the heat-development-type photosensitive material is to be processed through application of heat.

In the photosensitive material processing apparatus according to the sixth aspect, only when the heat-development-type photosensitive material is to be processed through application of heat, the processing member cassette is brought into contact with the heating drum through operation of the holding means. Accordingly, the processing member is not unnecessarily heated at times other than during an actual heat development, thereby preventing an unnecessary deterioration of the processing member.

According to a seventh aspect of the present invention, in the photosensitive material processing apparatus according to any of the first to sixth aspects, there is further provided application means for applying a predetermined image-forming solvent to the heat-development-type photosensitive material or the processing member or both before the heat-development-type photosensitive material is held between the heating drum and the processing member.

In the photosensitive material processing apparatus according to the seventh aspect, since the predetermined image-forming solvent is applied to the heat-development-type photosensitive material or the processing member or both before the heat-development-type photosensitive material and the processing member are superimposed on one another, the heat-development-type photosensitive material closely contacts the processing member when they are superimposed on one another. Thus, a process of forming images on the heat-development-type photosensitive material can be evenly and effectively performed.

Particularly, in the photosensitive material processing apparatus according to the second aspect, the above-described application of a predetermined image-forming solvent makes a diffusible dye more transferable, thereby accelerating a process of forming recorded images on the heat-development-type photosensitive material.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

Figure 1:
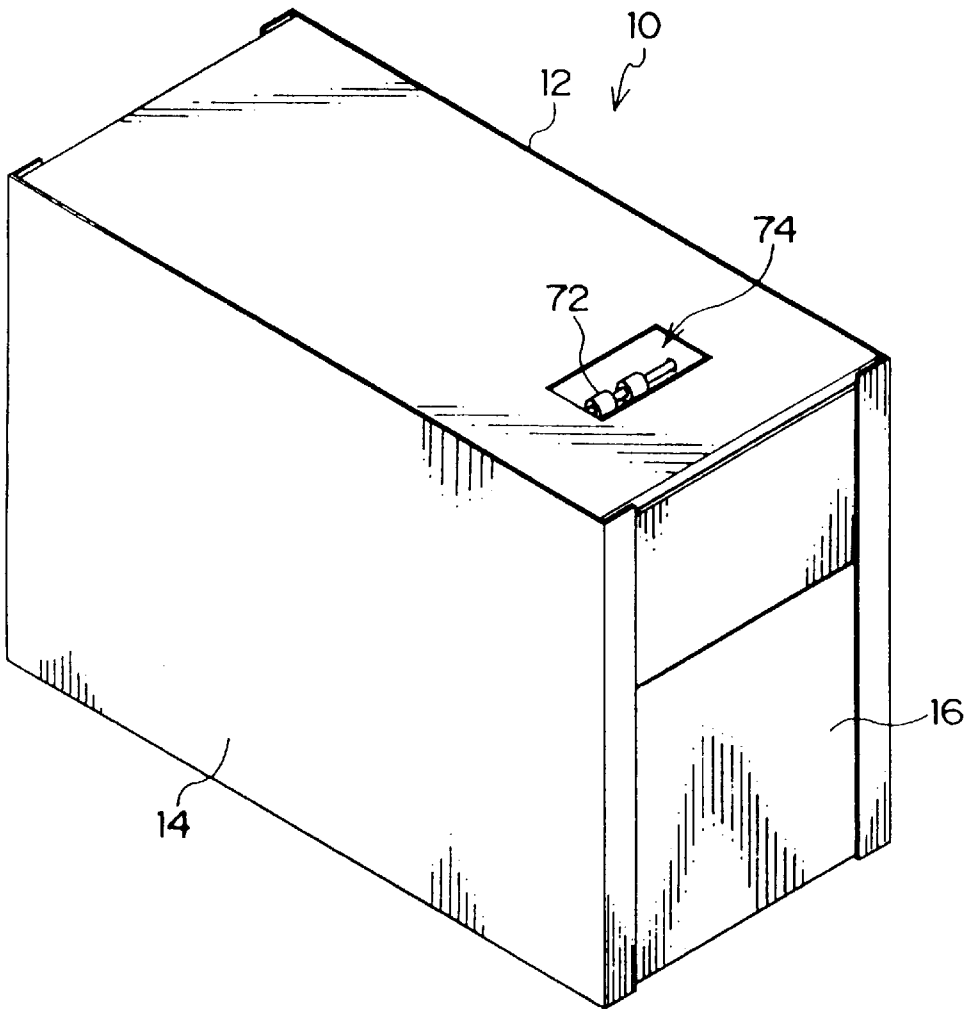
FIG. 1 is a perspective view showing the exterior appearance of a photosensitive material processing apparatus according to an embodiment of the present invention.
Figure 2:
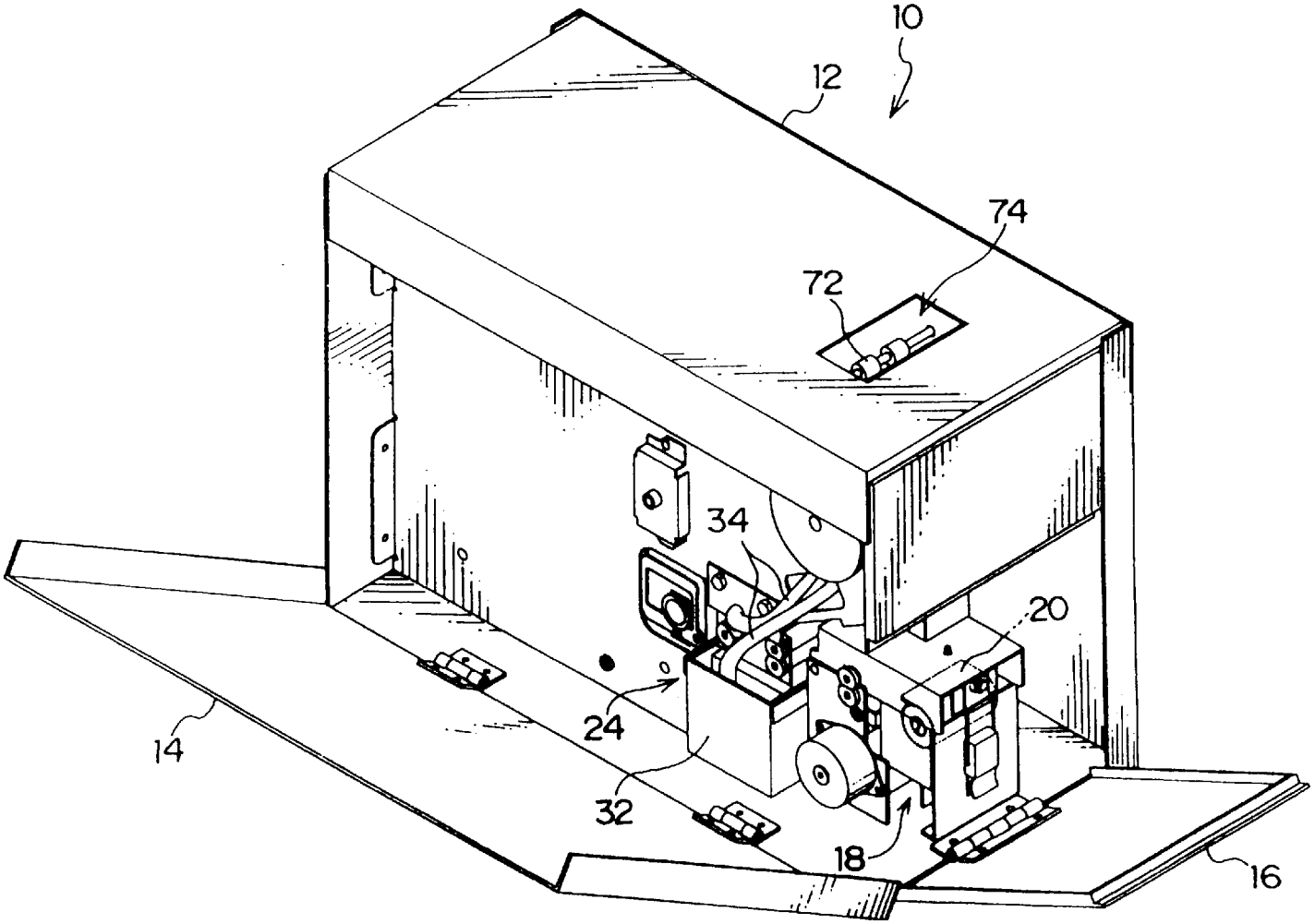
FIG. 2 is a perspective view showing the exterior appearance of the photosensitive material processing apparatus according to the embodiment in a state in which front and side panels are opened.
Figure 3:
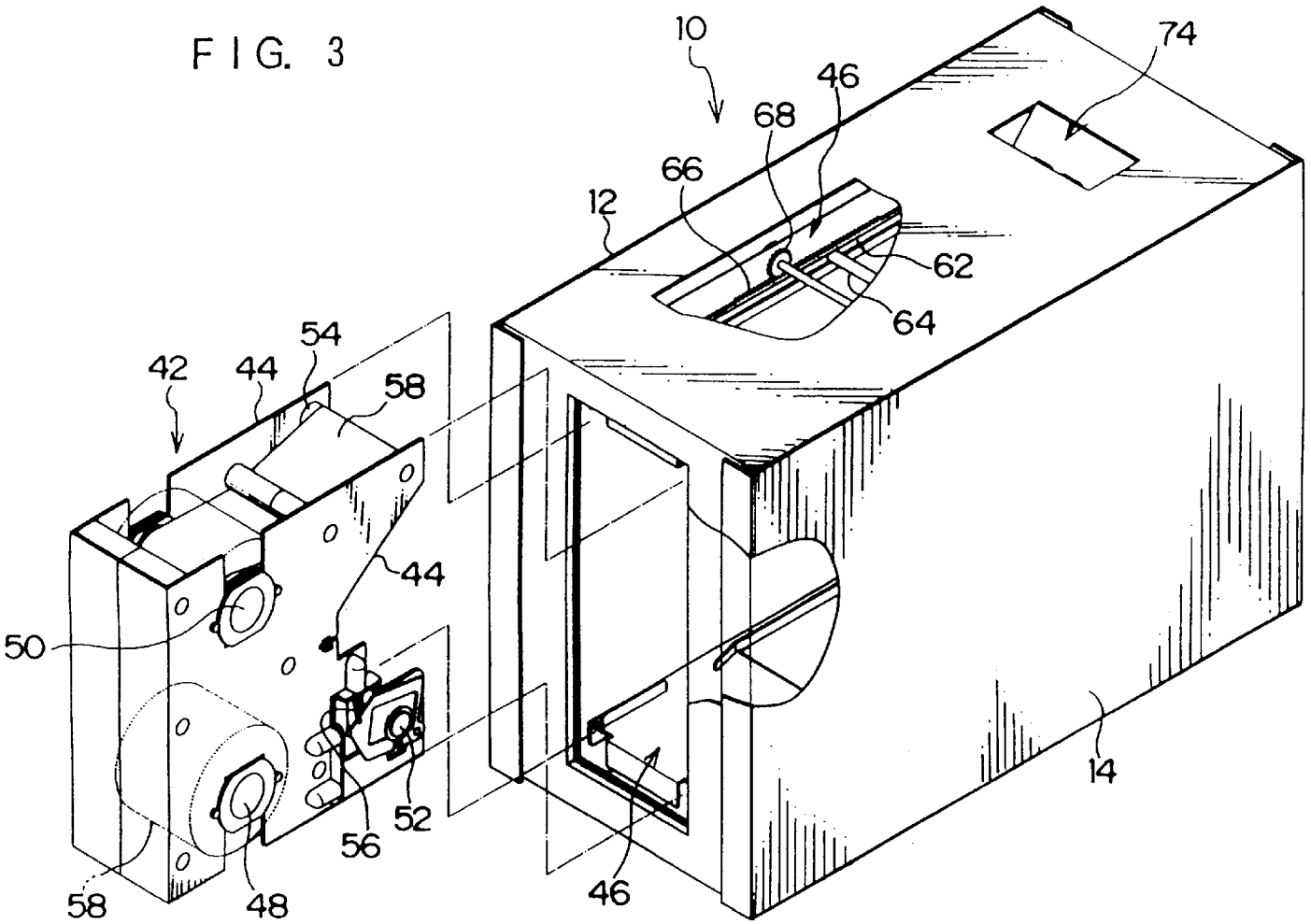
FIG. 3 is a perspective view showing the exterior appearance of the photosensitive material processing apparatus according to the embodiment in a state in which a processing member cassette is removed.
Figure 4:
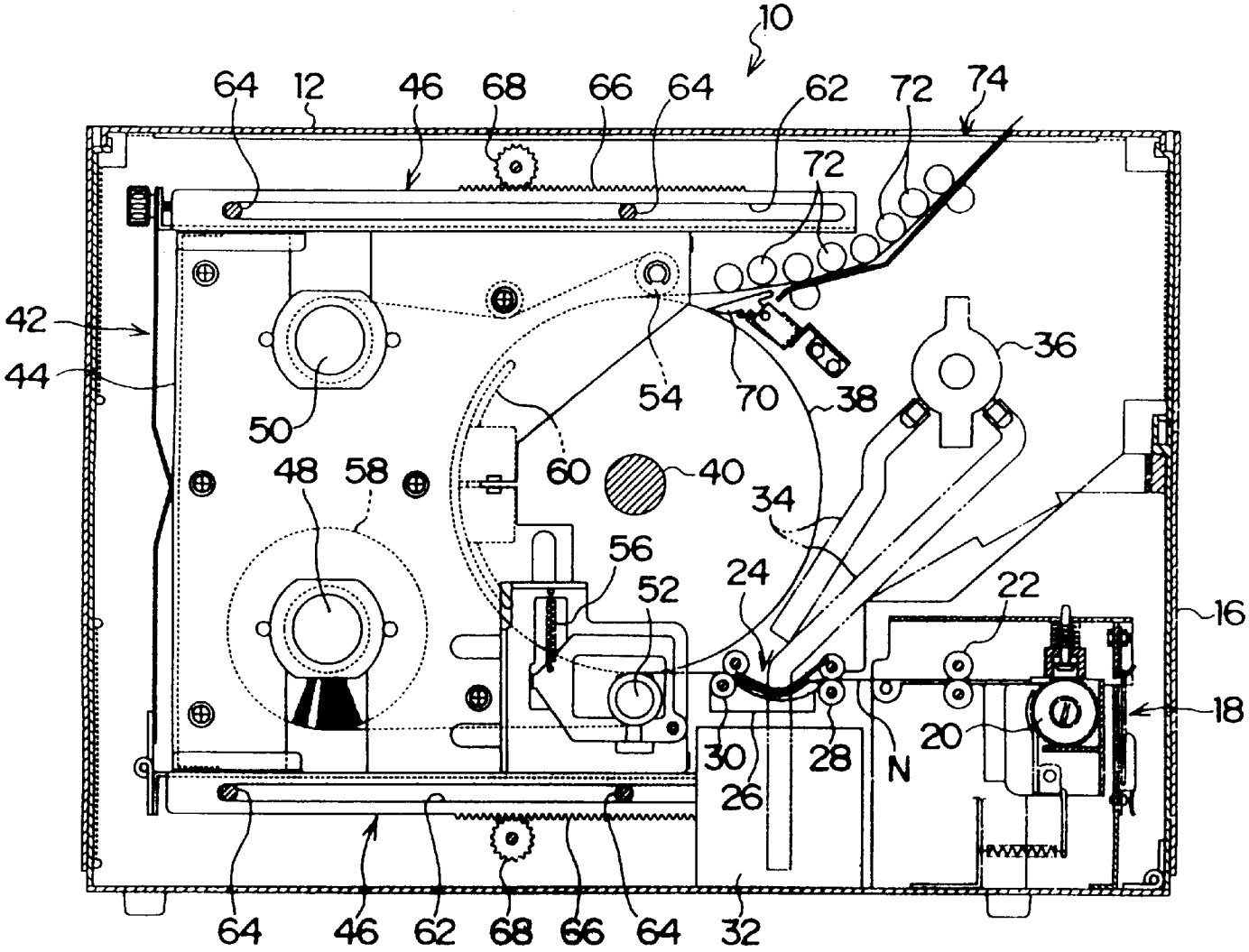
FIG. 4 is a view showing the overall structure of the photosensitive material processing apparatus according to the embodiment.
Figure 5:
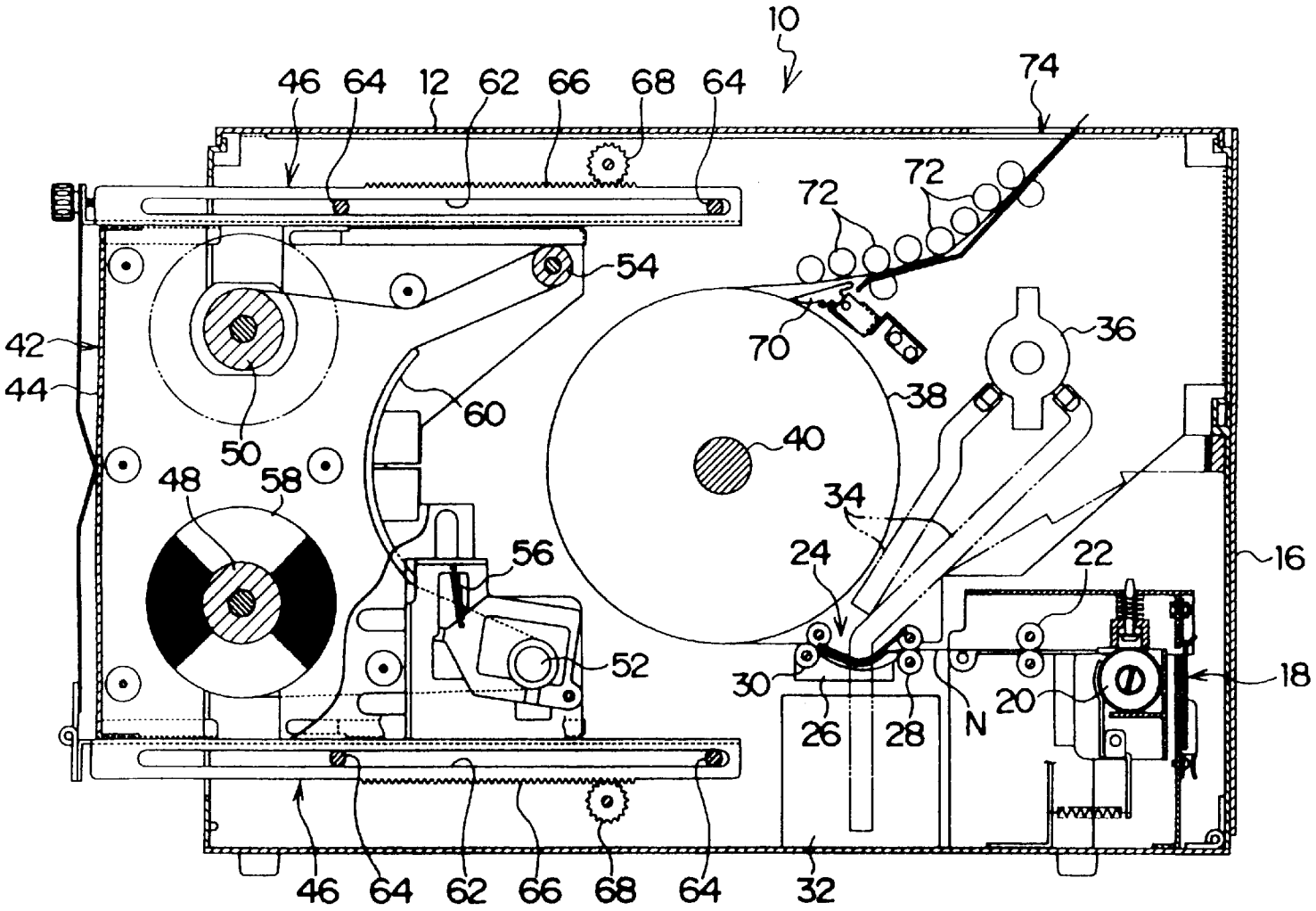
FIG. 5 is a view showing the overall structure of the photosensitive material processing apparatus according to the embodiment in a state in which the processing member cassette is moved away from a heating drum.

FIGS. 1 to 3 perspectively show the exterior appearance of a photosensitive material processing apparatus 10 according to an embodiment of the present invention. FIGS. 4 and 5 show the interior structure of the photosensitive material processing apparatus 10.

A body 12 of the photosensitive material processing apparatus 10 is shaped like a box. As shown in FIG. 2, the body 12 comprises a front panel 14 located at the front thereof and a side panel 16 located at the right-hand side thereof. The front and side panels 14 and 16, respectively, can be opened to thereby expose the interior of the body 12 to the exterior thereof.

A film cassette magazine 18 is provided at a corner portion of the body 12 on the side that faces the side panel 16. By opening the side panel 16, the film cassette magazine 18 is exposed to the exterior of the body 12, so that a film cassette 20 which contains a film N can be loaded thereinto.

Transport rollers 22 are disposed in the vicinity of the film cassette magazine 18 so as to draw the film N out of the film cassette 20 and transport the film forward.

The film N used in the present embodiment corresponds to a coloring material-containing heat-development-type photosensitive material of the present invention and comprises a support and at least three light-sensitive layers provided on the support. The at least three light-sensitive layers have their individual sensitivities in different wavelength regions. Each of the layers comprises light-sensitive silver halide, a binder, and a coloring material capable of releasing or dispersing diffusible dyes imagewise, and the coloring materials of the respective layers will have different hues after development.

A water application unit 24 serving as application means is disposed downstream of the film cassette magazine 18 (the transport roller 22) in relation to a transport direction.

The water application unit 24 is exposed to the exterior of the body 12 by opening the front door 14 and has an application tank 26. The application tank 26 is shaped like a dish and contains water serving as an image-forming solvent. Feed rollers 28 are disposed at the upstream end portion of the application tank 26 in relation to the transport direction of the film N. and squeeze rollers 30 are disposed at the downstream end portion of the application tank 26 in relation to the transport direction of the film N. Accordingly, when water is contained in the application tank 26, water is applied to the film N which is fed into the application tank 26 by the feed roller 28. Further, excess water is removed from the water-applied film N while it is being held between and transported by the squeeze rollers 30.

A storage tank 32 is disposed under the application tank 26. The storage tank 32 contains water serving as an image-forming solvent and is connected to the application tank 26 via a pipe 34, a pump 36, etc. Thus, water can be fed from the storage tank 32 to the application tank 26 for replenishment, and water can be drained (returned) from the application tank 26 to the storage tank 32.

A heating drum 38 is disposed in the vicinity of and downstream of the water application unit 24 in relation to the transport direction. The heating drum 38 is rotatably supported by the body 12 and is rotatively driven by an unillustrated drive system. The heating drum 38 accommodates a halogen lamp 40 so as to heat the heating drum 38.

A processing member cassette 42 is loaded to the body 12 from the side opposite to the film cassette magazine 18 with respect to the heating drum 38. The processing member cassette 42 has a box-like structure formed by two holding plates 44 opposingly arranged in parallel with one another and is removably attached to slidable holding units 46 located at the upper and lower portions of the body 12. Thus, the processing member cassette 42 can be removed from the body 12 as shown in FIG. 3.

A processing member roll 48, a take-up roller 50, a guide roller 52, and a guide roller 54 are supported between the two holding plates 44 of the processing member cassette 42. The guide roller 52 is biased by a spring 56 so as to serve as a press roller for holding the film N between the heating drum 38 and a processing sheet 58, which will be described later.

The processing sheet 58 serving as a processing member is wound in roll form on the processing member roll 48. The processing sheet 58 comprises a support and a layer provided on the support, which layer contains a mordant for developing the film N. The processing sheet 58 extending from the processing member roll 48 is threaded along the guide rollers 52 and 54, and then its end portion is fixed to the take-up roller 50.

A holding projection 60 is formed on each holding plate 44 to be located between the guide rollers 52 and 54 and has a shape corresponding to the curve of the heating drum 38 to thereby hold the unwound portion of the processing sheet 58 at transverse edge portions thereof and give a predetermined curve thereto.

A guide hole 62 is formed in each slidable holding unit 46 for holding the processing member cassette 42 and receives guide pins 64 fixedly provided on the body 12. Thus, the slidable holding units 46 can slide within the body 12 toward and away from the heating drum 38 while holding the processing member cassette 42. Also, a rack 66 is formed on each slidable holding unit 46 along the guide hole 62, and pinions 68 provided on the body 12 engage with the racks 66. Thus, through rotation of the pinions 68 driven by an unillustrated motor, the slidable holding units 46, i.e. the processing member cassette 42 slides toward and away from the heating drum 38.

When the processing member cassette 42 held by the slidable holding units 46 approaches the heating drum 38, the unwound portion of the processing sheet 58 extending from the processing member roll 48 and between the guide rollers 52 and 54 is pressed against the circumference of the heating drum 38. Accordingly, in this state, the film N fed from the water application unit 24 can be held between the heating drum 38 and the unwound portion of the processing sheet 58 and can be transported forward.

When the temperature of the heating drum 38 is to be regulated (for example, increased), the pinions 68 are driven so as to move the slidable holding units 46 (the processing member cassette 42) away from the heating drum 38, as shown in FIG. 5.

A separation pawl 70 is disposed in the vicinity of the upper portion of the heating drum 38. The separation pawl 70 separates the film N, which has been transported while being held between the heating drum 38 and the processing sheet 58, from the heating drum 38.

A plurality of transport rollers 72 are provided in the vicinity of the separation pawl 70 so as to transport the film N, which has been separated from the heating drum 38, further forward, so that the film N is ejected through an outlet 74 provided in the upper corner portion of the body 12.

Next, operation of the present embodiment will be described.

In the photosensitive material processing apparatus 10 having the above-described structure, the processing sheet 58 is wound in roll form on the processing member roll 48 of the processing member cassette 42. Further, the processing sheet 58 extending from the processing member roll 48 is routed along the guide rollers 52 and 54, and then its end portion is fixed to the take-up roller 50. The processing member cassette 42 in this state is loaded to the slidable holding units 46.

In this case, even when the processing member cassette 42 is removed from the body 12, the unwound portion of the processing sheet 58 (extending between the guide rollers 52 and 54) is held in a predetermined curve by the holding projections 60. Thus, the processing sheet 58 becomes neither too slack nor too tight when the processing member cassette 42 is loaded to or unloaded from the body 12.

Next, an operator loads the film cassette 20, which contains the film N bearing images recorded in each frame, into the film cassette magazine 18, and then operates an unillustrated start button. As a result, a heat development process starts for the film N.

In this case, the processing member cassette 42 (the slidable holding units 46) is moved away from the heating drum 38 through operation of the pinions 68 and is kept apart (as shown in FIG. 5) until the heating drum 38 reaches a predetermined temperature.

When the heating drum 38 reaches a predetermined temperature, the pinions 68 are rotated so as to move the processing member cassette 42 (the slidable holding units 46) toward the heating drum 38, thereby pressing the unwound portion of the processing sheet 58 extending from the processing member roll 48 and between the guide rollers 52 and 54 against the periphery of the heating drum 38 (as shown in FIG. 4).

In this case, even when the processing sheet 58 (the processing member cassette 42) is moved away from the circumference of the heating drum 38, the unwound portion of the processing sheet 58 (extending between the guide rollers 52 and 54) is held in a predetermined curve by the holding projections 60. Thus, the processing sheet 58 becomes neither too slack nor too tight. Accordingly, when the processing member cassette 42 is moved toward the heating drum 38, the processing sheet 58 is reliably pressed against the heating drum 38.

Next, the film N is drawn out from the film cassette 20 and is transported forward. Subsequently, the film N passes the interior of the application tank 26 of the water application unit 24 so that water is applied thereto.

The thus water-applied film N is lead into the space between the lower portion of the heating drum 38 and the guide roller 52. Then, the film N is held between the processing sheet 58 guided by the guide roller 52 and the circumference of the heating drum 38 and is transported clockwise in FIG. 4 on the circumference of the heating drum 38. At this time, the processing sheet 58 is also transported at the same transport speed as that of the film N. Since water is applied to the film N, the film N and the processing sheet 58 are transported on the circumference of the heating drum 38 while they are in a close contact with one another.

When the leading end of the film N reaches the end of a predetermined heating range, transport of the film N and the processing sheet 58 is temporarily halted, and the film N and the processing sheet 58 are heated for a predetermined period of time.

Through application of heat to the film N and the processing sheet 58 which are superimposed on one another, a diffusible dye is imagewise emitted or diffused from a coloring material contained in the film N, so that part or all of the diffusible dye is removed from the film N. As a result, a color image in at least three colors is developed on the film N. Since water adheres to the film N as already mentioned, the film N evenly undergoes heat development.

Upon completion of heating for a predetermined period of time, transport of the film N and the processing sheet 58 resumes.

Subsequently, when the film N and the processing sheet 58 reach the upper portion of the heating drum 38, the processing sheet 58 is routed along the guide roller 54 to thereby be separated from the film N and be taken up by the take-up roller 50, while the film N is separated from the heating drum 38 by the separation pawl 70. The separated film N is transported by the transport rollers 72 toward the outlet 74 and is then ejected from the body 12 through the outlet 74.

The film N is heat-developed as described above. Subsequently, images recorded on the film N is digitally read by a digital image reader or the like. The thus-read image data is input to a digital printer or the like to thereby obtain a photographic print of images recorded in each frame of the film N.

As has been described above, the photosensitive material processing apparatus 10 according to the present embodiment uses the processing sheet 58 comprising a support and a layer which is provided on the support and contains a mordant for developing the film N, so that the film N on which images are recorded through exposure (photography) is easily heat-developed to thereby form images with no requirement of conventional troublesome developing, bleaching, and fixing.

Also, in the photosensitive material processing apparatus 10, water serving as an image-forming solvent is applied to the film N before the film N and the processing sheet 58 are superimposed on one another. Accordingly, a diffusible dye becomes more diffusive to thereby more effectively form images on the film N.

In the present embodiment described above, transport of the film N is temporarily halted while the film N is held between the processing sheet 58 and the heating drum 38, and the entire film N is heat-developed at a time. However, the film N may be transported at a constant speed while being held between the processing sheet 58 and the heating drum 38, and during this transport, the film N may be heat-developed through continuous application of heat. Through this constant-speed transport of the film N, each frame of the film N is heated for the same period of time, thereby attaining streak-free heat development. Also, this heat development method neither requires the heating range of the heating drum 38 to be sufficiently large to cover the entire film N nor requires intermittent transport of the film N and the processing sheet 58.

In the present embodiment described above, water serving as an image-forming solvent is applied to the film N. However, water may be applied to the processing sheet 58 or both of the film N and the processing sheet 58.

In the present embodiment described above, the coloring material-containing heat-development-type photosensitive material of the present invention is used as the film N. However, the film N may be the coupler-containing heat-development-type photosensitive material of the present invention, which coupler-containing heat-development-type photosensitive material comprises a support and at least three kinds of photosensitive layers provided on the support. Each of the photosensitive layers contains at least photosensitive silver halide, a binder, and a dye-providing coupler, and the photosensitive layers are different in the range of a photosensitive wavelength and the hue of a dye to be formed from the dye-providing coupler.

The film N may assume the ordinary film cassette type form or a form capable of recording magnetic information so as to be compatible with an advanced photo system (APS).

As has been described above, according to the present invention, a heat-development-type photosensitive material on which images are recorded through exposure can be easily heat-developed to thereby form images with no requirement of conventional troublesome developing, bleaching, and fixing. Also, since processing solutions and the like are not used, a user is released from troublesome storage and replenishment control of such solutions and cleaning of apparatus, thereby obtaining improved maintainability of a system.

What is claimed is:

1. A photosensitive material processing apparatus which forms images on a heat-development-type photosensitive material that is developed through application of heat, comprising:

a heating drum;

a processing member which is housed in a rolled form;

a processing member cassette in which said processing member is housed in a rolled form, and in which an unwound portion of said processing member is exposed so as to be pressed against the circumference of said heating drum, said processing member cassette including a take-up unit for taking up the unwound portion of said processing member in a rolled form after said heat-development-type photosensitive material is transported while being held between the unwound portion of said processing member and said heating drum, said processing member cassette being removable from a processor body; and holding means for holding said processing member cassette such that it can move toward and away from said heating drum; wherein images are formed on said heat-development-type photosensitive material by transporting and heating said heat-development-type photosensitive material in a state in which said heat-development-type photosensitive material is sandwiched between said heating drum and the unwound portion of said processing member and is superimposed on the unwound portion of said processing member.

2. A photosensitive material processing apparatus according to claim 1, wherein said processing member cassette has a holding projection for holding the unwound portion of said processing member in a curved state so as to press the unwound portion against the circumference of said heating drum.

3. A photosensitive material processing apparatus according to claim 2, wherein said holding means brings said processing member cassette into contact with said heating drum only when said heat-development-type photosensitive material is subjected to heating process.

4. A photosensitive material processing apparatus according to claim 3, wherein there is further provided application means which applies a predetermined image-forming solvent to at least one of said heat-development-type photosensitive material and said processing member before said heat-development-type photosensitive material is held between said heating drum and said processing member.

5. A photosensitive material processing apparatus according to claim 2, wherein there is further provided application means which applies a predetermined image-forming solvent to at least one of said heat-development-type photosensitive material and said processing member before said heat-development-type photosensitive material is held between said heating drum and said processing member.

6. A photosensitive material processing apparatus according to claim 1, wherein said holding means brings said processing member cassette into contact with said heating drum only when said heat-development-type photosensitive material is subjected to heating process.

7. A photosensitive material processing apparatus according to claim 6, wherein there is further provided application means which applies a predetermined image-forming solvent to at least one of said heat-development-type photosensitive material and said processing member before said heat-development-type photosensitive material is held between said heating drum and said processing member.

8. A photosensitive material processing apparatus according to claim 1, wherein there is further provided application means which applies a predetermined image-forming solvent to at least one of said heat-development-type photosensitive material and said processing member before said heat-development-type photosensitive material is held between said heating drum and said processing member.

9. A photosensitive material processing apparatus which forms images on a heat-development-type photosensitive material that is developed through application of heat, comprising:

a heating drum;

a processing member which is housed in a rolled form and;

a processing member cassette in which said processing member is housed in a rolled form, and an unwound portion of said processing member is exposed so as to be pressed against the circumference of said heating drum, said processing member cassette including a take-up unit for taking up the unwound portion of said processing member in a rolled form after said heat-development-type photosensitive material is transported while being held between the unwound portion of said processing member and said heating drum, said processing member cassette being removable from a processor body; and holding means for holding said processing member cassette such that it can move toward and away from said heating drum; wherein said heat-development-type photosensitive material comprises a support on which is provided at least three light-sensitive layers which have their individual sensitivities in different wavelength regions, each of the layers comprising light-sensitive silver halide, a binder, and a coloring material capable of releasing or dispersing a diffusible dye imagewise, the coloring materials of the respective layers having different hues after development;

said processing member comprises a support on which is provided at least a layer including a mordant; and wherein images are formed on said heat-development-type photosensitive material by transporting and heating said heat-development-type photosensitive material in a state in which said heat-development-type photosensitive material is sandwiched between said heating drum and the unwound portion of said processing member and is superimposed on the unwound portion of said processing member.

10. A photosensitive material processing apparatus according to claim 9, wherein said processing member cassette has a holding projection for holding the unwound portion of said processing member in a curved state so as to press the unwound portion against the circumference of said heating drum.

11. A photosensitive material processing apparatus according to claim 9, wherein said holding means brings said processing member cassette into contact with said heating drum only when said heat-development-type photosensitive material is subjected to heating process.

12. A photosensitive material processing apparatus according to claim 10, wherein said holding means brings said processing member cassette into contact with said heating drum only when said heat-development-type photosensitive material is subjected to heating process.

13. A photosensitive material processing apparatus which forms images on a heat-development-type photosensitive material that is developed through application of heat, comprising:

a heat drum;

a processing member which is housed in a rolled form;

a processing member cassette in which said processing member is housed in a rolled form, and an unwound portion of said processing member is exposed so as to be pressed against the circumference of said heating drum, said processing member cassette including a take-up unit for taking up the unwound portion of said processing member in a rolled form after said heat-development-type photosensitive material is transported while being held between the unwound portion of said processing member and said heating drum, said processing member cassette being removable from a processor body; and holding means for holding said processing member cassette such that it can move toward and away from said heating drum; wherein said heat-development-type photosensitive material comprises a support on which is provided at least three light-sensitive silver halide, a binder, and a dye-providing coupler, the dyes formed from dye-providing couplers in the respective layers being different in hue; and wherein images are formed on said heat-development-type photosensitive material by transporting and heating said heat-development-type photosensitive material in a state in which it is sandwiched between said heating drum and the unwound portion of said processing member and is superimposed on the unwound portion of said processing member.

14. A photosensitive material processing apparatus according to claim 13, wherein said processing member cassette has a holding projection for holding the unwound portion of said processing member in a curved state so as to press the unwound portion against the circumference of said heating drum.

15. A photosensitive material processing apparatus according to claim 14, wherein said holding means brings said processing member cassette into contact with said heating drum only when said heat-development-type photosensitive material is subjected to heating process.

16. A photosensitive material processing apparatus according to claim 13, wherein said holding means brings said processing member cassette into contact with said heating drum only when said heat-development-type photosensitive material is subjected to heating process.

* * * * *